US005528341A

United States Patent [19]

Shishido et al.

[11] Patent Number: 5,528,341

[45] Date of Patent: Jun. 18, 1996

[54] PROCESS CARTRIDGE WITH ROTARY MEMBER HAVING BEARING ATTACHMENT PORTIONS OF DIFFERENT DIAMETERS, AND METHOD FOR REFUSING SUCH A ROTARY MEMBER

[75] Inventors: Kazuo Shishido, Kawasaki; Hiroaki Miyake, Yokohama; Yoshiya Nomura, Tokyo; Kenji Matsuda; Minoru Sato, both of Yokohama, all of Japan

[73] Assignee: Canon Kabushiki Kaisha, Tokyo, Japan

[21] Appl. No.: 197,571

[22] Filed: Feb. 17, 1994

Related U.S. Application Data

[63] Continuation of Ser. No. 863,755, Apr. 6, 1992, abandoned.

[30] Foreign Application Priority Data

Apr. 8, 1991 [JP] Japan ..... 3-103110
Mar. 25, 1992 [JP] Japan ..... 4-067316

[51] Int. Cl.[6] ..... G03G 15/06; G03G 21/00

[52] U.S. Cl. ..... 355/200; 355/259

[58] Field of Search ..... 355/200, 210, 355/251, 259, 299

[56] References Cited

U.S. PATENT DOCUMENTS 3,927,936 12/1975 Komori et al. ..... 355/299
4,618,240 10/1986 Sakurai et al. ..... 355/290 X
4,806,971 2/1989 Masham ..... 355/251
4,823,160 4/1989 Ikuta et al. ..... 355/211
4,937,633 6/1990 Ewing ..... 355/299
4,951,599 8/1990 Damji ..... 355/251 X
4,975,746 12/1990 Miyauchi et al. ..... 355/245
5,023,660 6/1991 Ebata et al. ..... 355/200
5,023,670 6/1991 Kita et al. ..... 355/211 X
5,036,358 7/1991 Yoshida ..... 355/245 X
5,142,322 8/1992 Surti ..... 355/200

*Primary Examiner*—Fred L. Braun
*Attorney, Agent, or Firm*—Fitzpatrick, Cella, Harper & Scinto

[57] ABSTRACT

A process cartridge includes a rotatable rotary member having a plurality of bearing attachment portions to which bearings are attachable. The plurality of bearing attachment portions are provided on the rotary member with different diameters. A method of reusing a rotation member that is supported at one of a plurality of coaxial rotation surfaces having different diameters includes detaching one of a plurality of bearing members that supports the rotation member at the one of the plurality of coaxial rotation surfaces. Another of the plurality of bearing members is then attached at a corresponding other of the plurality of coaxial rotation surfaces that has a different diameter than the one of the plurality of coaxial rotation surfaces.

13 Claims, 8 Drawing Sheets

251
259
201

258
257
m
256

258
256
251
249
250
201

PROCESS CARTRIDGE WITH ROTARY MEMBER HAVING BEARING ATTACHMENT PORTIONS OF DIFFERENT DIAMETERS, AND METHOD FOR REFUSING SUCH A ROTARY MEMBER

This application is a continuation of application Ser. No. 07/863,755, filed Apr. 6, 1992, now abandoned.

BACKGROUND OF THE INVENTION

1. Field of the Invention

The present invention relates to an image forming system such as a copying machine, printer and the like, and a process cartridge removably mountable within such image forming system, and more particularly, it relates to an image forming system and a process cartridge each having parts which are reusable even after the disassembling or destruction of the image forming system and the process cartridge.

2. Related Background Art

In an image forming system and a process cartridge removably mountable within the image forming system, it is preferable that parts or elements are reused as much as possible from the view points of economization and/or environment protection. That is to say, various parts which constitute the process cartridge a previously used image forming system that has been withdrawn from use, for example, because the photosensitive member, has worn out are preferably reused in the manufacture of new process cartridges and image forming systems.

However, in the past, it was difficult to reuse abutment members abutting or urging against moving parts, since such abutment members and/or moving parts had been worn due to the frictional sliding therebetween.

For example, the case of a cleaning blade and a developer blade which are urged against a photosensitive drum will be considered. In the case of the cleaning blade, since it is made of urethane rubber or similar materials which are subjected to creep for a long time, if it is reused, a contacting pressure between the cleaning blade and the photosensitive drum, and a penetrating amount of the cleaning blade against the drum are decreased in comparison with the desired levels. Thus, when the cleaning blade is reused, the residual toner remaining on the photosensitive drum cannot be removed completely, with the result that the toner still remaining on the drum may generate black stripes on a copied image. On the other hand, when the developer blade regulating an amount of developer (toner) adhering onto a developing roller is reused, the charge amount of the developer is decreased, thus reducing the image density.

Incidentally, in image forming systems not utilizing process cartridges, if such cleaning blade and/or developer blade are reused, the same problems will occur.

SUMMARY OF THE INVENTION

The present invention aims to eliminate the above-mentioned conventional drawback, and has an object to provide a process cartridge and an image forming system which utilizes reusable parts.

Another object of the present invention is to provide a process cartridge and an image forming system which comprise a moving member, an abutment member urged against the moving member, and a means capable of mounting the abutment member at a first position and a second position different from the first position.

The other objects of the present invention will be apparent from the following descriptions.

DETAILED DESCRIPTION OF THE PREFERRED EMBODIMENTS

The present invention will now be explained in connection with embodiments thereof with reference to the accompanying drawings. Incidentally, hereinafter, a process cartridge utilizing "reusable parts which can still be used even after a service life of a process cartridge is expired" will be explained. However, the present invention is not limited to such process cartridge, but may be applied to an image forming system utilizing reusable parts. Here, the fact that a service life of a process cartridge is expired means that, for example, a service life of a photosensitive member included in the cartridge is expired or developer included in the cartridge becomes empty or is used up. Further, reusable parts may be used with the body of the system or cartridge.

Figure 5:
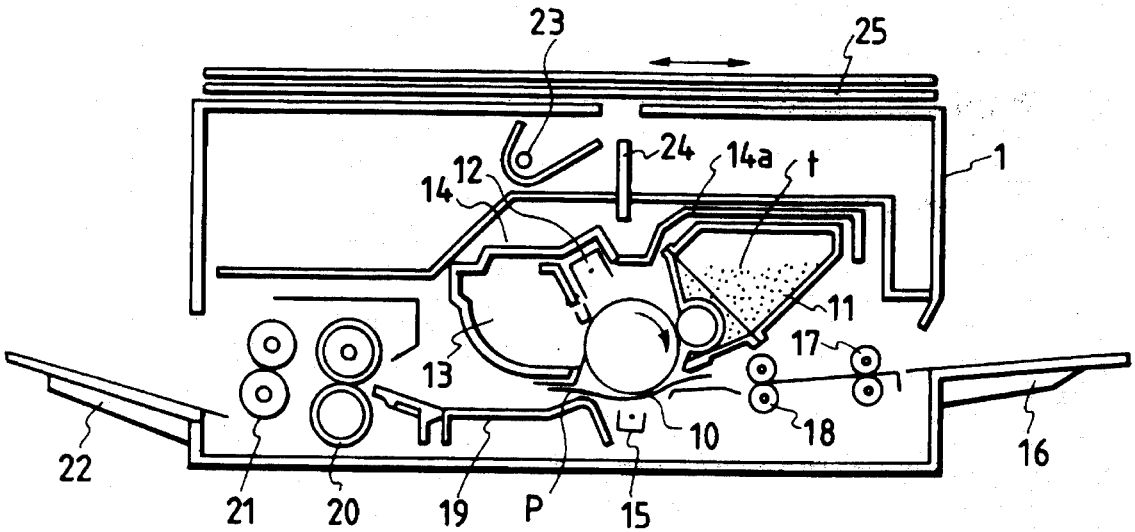
FIG. 5 is an elevational sectional view of an image forming system according to the present invention.

First of all, an image forming system will briefly be explained with reference to FIG. 5.

Process means for forming an image, such as a developing device 11, a primary charger 12 and a cleaning device 13 are arranged around a photosensitive drum 10 acting as an image bearing member. These process means are bodily incorporated into a housing 14*a* of a process cartridge 14 which can removably be mounted within an image forming system 1. In this way, when it is desired to perform the maintenance such as the replacement of the photosensitive drum (image bearing member) 10, the replacement of the developing device 11 or the replenishment of developer (toner t), the cleaning of a discharging wire of the primary charger 12, the replacement of the cleaning device 13 fitted with the waste toner, the adjustment or the replacement of various devices disposed around the photosensitive drum 10, or the like, which require skillful techniques and knowledge that to make the operator's handling difficult, the operator can perform such maintenance easily by replacing the whole process cartridge with a new one.

Within the process cartridge 14, a transfer charger 15 is arranged below the photosensitive drum 10. Further, a sheet supply tray 16, sheet supply rollers 17 and regist rollers 18 are disposed at an upstream side (sheet supplying side) of the transfer charger 15, and a transfer sheet guide 19, a fixing device 20, sheet ejector rollers 21 and a sheet ejection tray 22 are disposed at a downstream side (sheet ejecting side) of the transfer charger. Further, a lighting lamp 23 for illuminating an original document, and a short focus optical element array 24 for exposing the photosensitive drum 10 with light reflected from the original are arranged above the photosensitive drum 10. In addition, an original support plate 25 shiftable in direction shown by the double arrow is arranged on the frame 1 of the image forming system.

When a light image from the original resting on the original support plate 25 is sent, via the lighting lamp 23 and the short focus optical element array 24, to the photosensitive drum 10 uniformly charged by the primary charger 12, an electrostatic latent image is formed on the photosensitive drum 10. The electrostatic latent image is sent to the developing device 11 as the photosensitive drum is further rotated, and is developed by the developing device 11 with the toner t to form a toner image. Then, the toner image is transferred onto a transfer sheet P by the transfer charger 15. That is to say, the transfer sheet P is supplied from the sheet supply tray 16 by the sheet supply rollers 17 to reach the regist roller 18, and then is interposed between the photosensitive drum 10 and the transfer charger 15 in registration with the toner image on the drum. Thus, the toner image on the photosensitive drum 10 is transferred onto the transfer sheet P. The transfer sheet P to which the toner image was transferred is sent to the fixing device 20, where the toner image is permanently fixed to the sheet. Thereafter, the transfer sheet is ejected by the ejector rollers 21 onto the ejection tray 22. On the other hand, after the transferring operation, the residual toner remaining on the photosensitive drum 10 is removed by the cleaning device 13, thus preparing it for the next image formation.

Next, a first embodiment of the present invention will be explained with reference to FIGS. 1 to 4.

Figure 4:
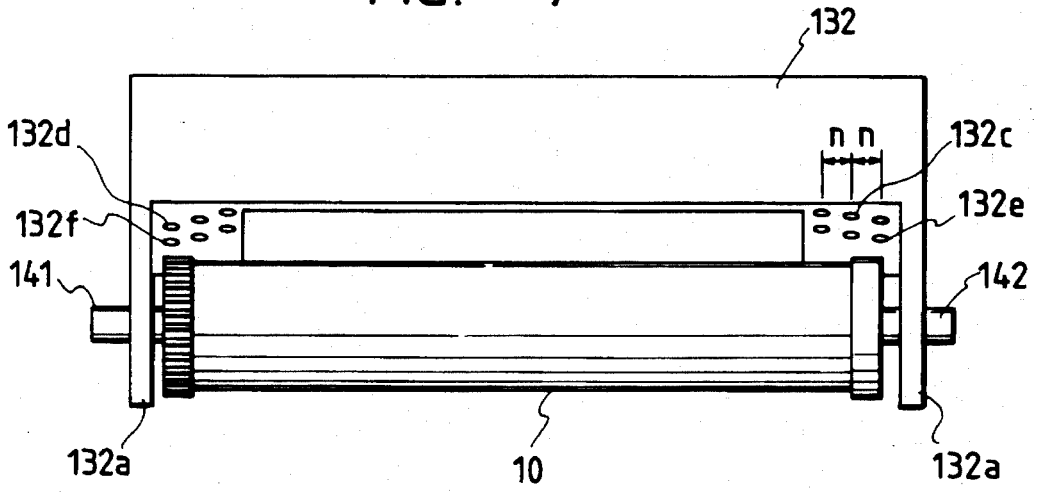
FIG. 4 is a view of the process cartridge looked at from a direction shown by the arrow A in FIG. 1.

The cleaning device 13 comprises a cleaning container 132 for collecting the residual toner on the photosensitive drum 10 which is a moving part, a cleaning blade, which is an abutment part, for removing the residual toner on the photosensitive drum 10, and a receiving sheet 134 for guiding the removed waste toner to the cleaning container (residual matter containing member) 132. As shown in FIG. 4, both end walls 132*a* of the cleaning container 132, i.e., in a plane perpendicular to an axial direction of the photosensitive drum 10 and extend toward the photosensitive drum 10 to rotatably support end shafts 141, 142 of the photosensitive drum 10. Further, the primary charger 12 is attached to the extended end walls 132*a*. The cleaning blade comprises a metal plate 131*b* acting as a second support member, and an urethane rubber portion 131*a* which are adhered to each other by an adhesive, and the urethane rubber portion 131*a* has a predetermined free length L. Now, the free length L is a distance between a free end of the metal plate 132*b* and an abutment position where the urethane rubber portion 131*a* is abutted against the photosensitive drum.

The cleaning container 132 has an opening 132*h* open to the photosensitive drum 10, and attachment surfaces 132*g* for attaching the cleaning blade thereto are provided at edges of the opening 132*h*. Thus, the cleaning container 132 serves also as a support member for the cleaning blade 131. The metal plate 131*b* of the cleaning blade is abutted against and attached to the attachment surfaces 132*f*.

The cleaning container 132 is provided at its both end portion with three holes 132*c*, 132*d*, respectively, into which pins for positioning the cleaning blade 131 are inserted. Each of the holes 132*c* is paired with the corresponding hole 132*d*, and positions of these holes 132*c*, 132*d* approach toward the free end of the blade 131 as they approach to the ends of the cleaning container. Below these holes 132*c*, 132*d*, are holes 132*e*, 132*f* for cooperating with tapping screws to secure the cleaning blade 131.

Figure 1:
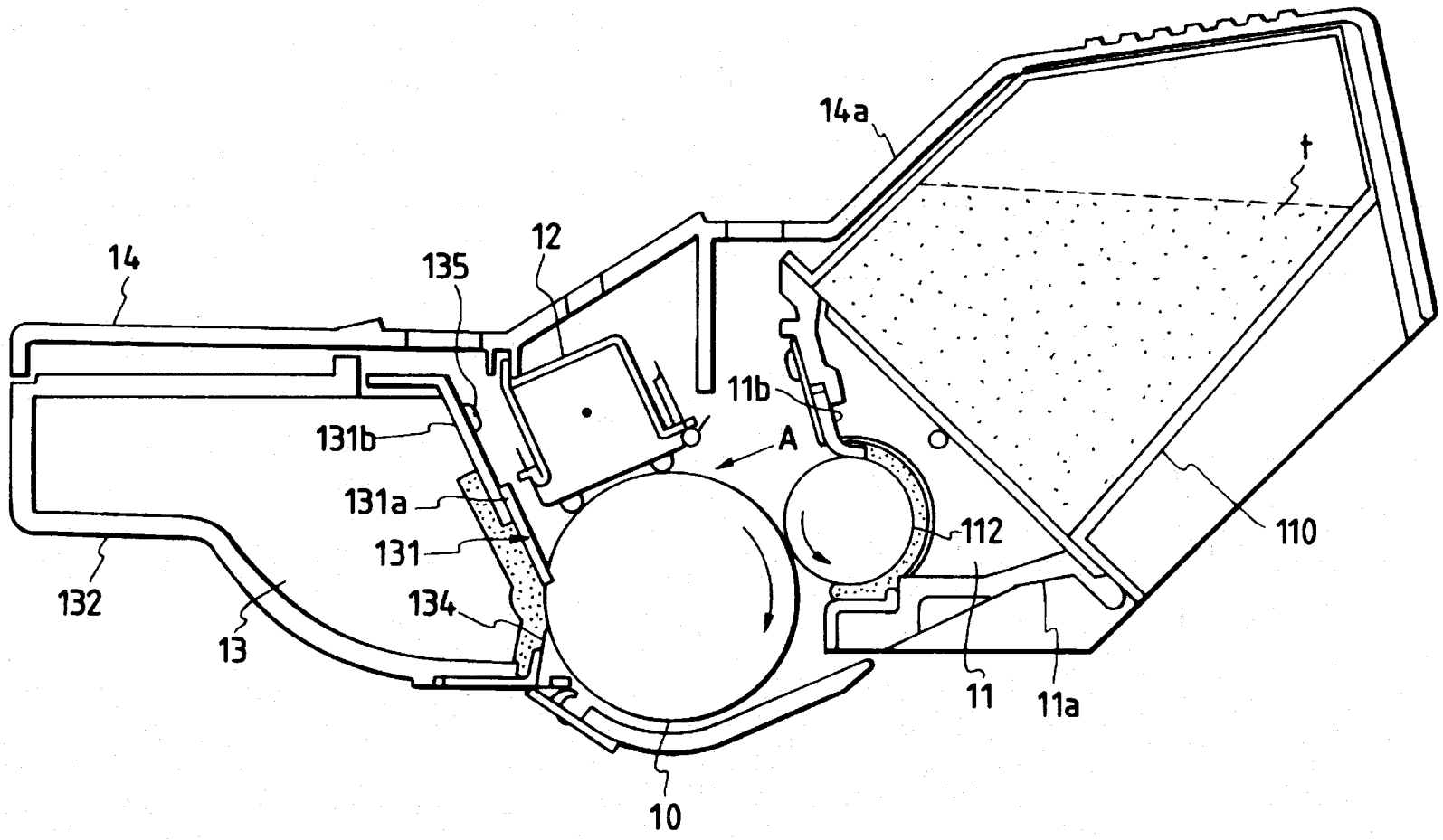
FIG. 1 is an elevational sectional view of a process cartridge according to the present invention.
Figure 2:
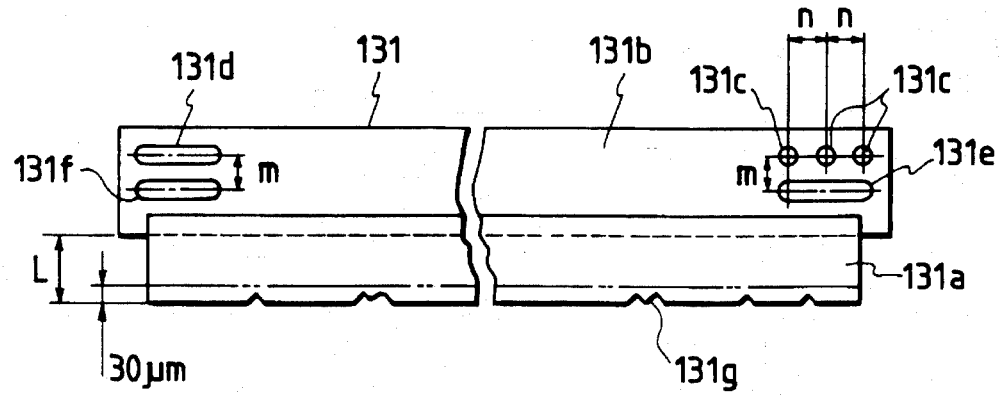
FIG. 2 is a view showing a cleaning blade used with an image forming system and a process cartridge according to a first embodiment of the present invention.
Figure 3:
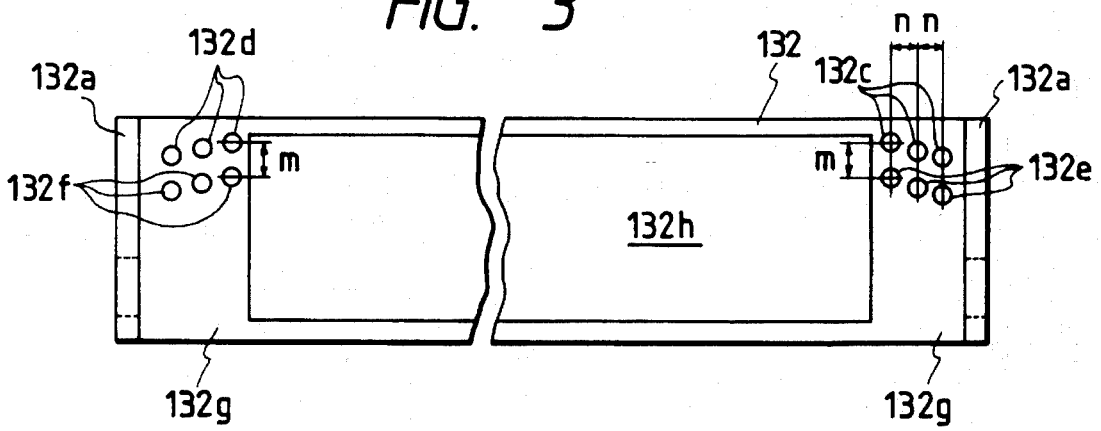
FIG. 3 is a view showing a residual matters collecting container according to a first embodiment of the present invention.

A left end portion of the metal plate 131*b* of the cleaning blade 131 has three positioning holes 131*c* aligned in a longitudinal direction of the cleaning blade and formed in the metal plate at a pitch n equal to a pitch n between the holes 132*c* of the cleaning container 132 in the longitudinal direction thereof. Further, as shown in FIG. 2, a positioning slot 131*d* is formed in a left end portion of the metal plate 131*b*. Attachment slots 131*e*, 131*f* are formed in the right and left end portions of the metal plate in parallel with the row of the positioning holes 131*c* and the slot 131*d*, respectively. That is to say, the holes 131*c* and slot 131*d* serve to position the blade 131 with respect to the support member 132, and the slots 131*e*, 131*f* serve to bias the blade toward the support member 132 for preventing the turn-up of the blade due to the rotation of the photosensitive drum. When the metal plate 131*b* of the cleaning blade is abutted aginst the attachment surfaces 132*e* of the cleaning container 132, by aligning the innermost positioning hole 131*c* of the cleaning blade 131 with the highest hole 132*c* and by aligning the left positioning slot 131*d* of the cleaning blade 131 with the highest hole 132*d* of the cleaning container 132, the highest left hole 132*d* of the cleaning container 132 will appear in the positioning slot 131*d* of the cleaning blade at the right end thereof. In this position, the cleaning blade 131 has been retracted.

Similarly, by aligning the central positioning hole 131*c* of the cleaning blade 131 with the central hole 132*c* of the cleaning container 132 and by aligning the left positioning slot 131*d* of the cleaning blade 131 with the central left hole 132*d* of the cleaning container 132, the central left hole 132*d* of the cleaning container 132 will appear in the positioning slot 131*d* of the cleaning blade at a central portion thereof. In this position, the cleaning blade 131 is in an intermediate position.

Similarly, by aligning the outermost positioning hole 131*c* of the cleaning blade 131 with the lowest hole 132*c* of the cleaning container 132 and by aligning the positioning slot 131*d* of the cleaning blade with the lowest hole 132*d*, the lowest hole 132*d* of the cleaning container 132 will appear in the positioning slot 131*d* at a left end thereof. In this position, the cleaning blade 131 is in an advanced position. Now, since the lower holes 132*e*, 132*f* for the tapping screws are formed in the attachment surface 132*g* of the cleaning container 132 below the holes 132*c*, 132*d* at a vertical distance or pitch m, respectively, and the attachment slots 131*e*, 132*f* are formed in the cleaning blade 131 below the positioning holes 131*c* and the slot 131*d* at the same vertical distance or pitch m, respectively, when the metal plate 131*b* of the cleaning blade 131 is abutted against the attachment surfaces 132*g* of the cleaning container 132 as mentioned above, the attachment slots 131*e*, 131*f* of the cleaning blade are aligned with any one of the lower holes 132*e*, 132*f* of the attachment surfaces 132*g*, respectively, without fail.

When a new cleaning blade 131 is used, since there is no creep in the urethane rubber portion 131*a*, positioning pins (not shown) are inserted into the innermost holes 132*c*, 132*d* of the cleaning container 132 and then are fitted into the corresponding positioning holes 131*c* and slot 131*d* of the metal plate 131*b* of the cleaning blade, thus positioning the cleaning blade 131 with respect to the cleaning container 132. After the positioning, the tapping screws are passed through the attachment slots 131*e*, 131*f* of the cleaning blade 131 and are threaded into the associated lower holes 132*e*, 132*f*. On the other hand, for example, when a previously used cleaning blade is reused, the degree of the creep of the urethane rubber portion 131*a* of the second-hand cleaning blade is measured, and the positions of the positioning pins are displaced outwardly in accordance with the degree of the creep so that the cleaning blade is attached to the cleaning container 132 in the intermediate or advanced position.

Further, if the blade is used for a long time, a tip edge of the urethane rubber portion 131*a* of the cleaning blade 131 urged against the photosensitive drum 10 is sometimes partially broken to produce about a 20 μm variation in the uniformity of the edge as indicated by 131*g*. So, before the second hand cleaning blade is reused, the tip edge of the cleaning blade is cut by about 30 μm in the free length direction. The cut-off amount is preferably in a range of 1 μm–1 mm in consideration of the desired urging force of the blade against the photosensitive drum. In this case, since the penetrating amount of the blade (when assembled) is decreased in accordance with the cut-off amount, the positioning pins are inserted into, for example, the outermost holes so that the cleaning blade 131 is attached to the cleaning container 132 in the advanced position.

As mentioned above, by changing the attachment position of the cleaning blade 131 to the cleaning container 132 in accordance with whether a new or second-hand cleaning blade is being used, it is possible to always maintain the urging force and the penetrating amount of the cleaning blade against the photosensitive drum constant. In this way, the conventional drawback regarding the poor image due to the creep of the reused cleaning blade can be eliminated.

As mentioned above, by uniformly cutting the tip edge (portion to be urged against the photosensitive drum) of the second-hand cleaning blade by 1 μm–1 mm in the free length direction before it is reused in a process cartridge, and by displacing the attachment position of the cleaning blade toward the photosensitive drum in accordance with the cut-off amount, it is possible to avoid the problem due to the broken edge of the blade and to reuse the blade effectively. Further, when the cut-out amount of the blade edge is previously coincided with the pitch between the positioning holes, the number of the reusage of the blade and accordingly the cartridge can be easily ascertained.

Further, the present invention can also solve the problem occurred by reusage of a developing device, as well as the cleaning device. That is to say, since surfaces of a sleeve flange and a bearing of the developing device are gradually worn while the developing device is being used for a long time, when the sleeve flange is reused in a process cartridge, it is feared that the reused sleeve flange is not properly fitted into a new bearing. An embodiment described hereinbelow aims to solve this problem so that a developing sleeve of the developing device can be reused effectively.

Figure 6:
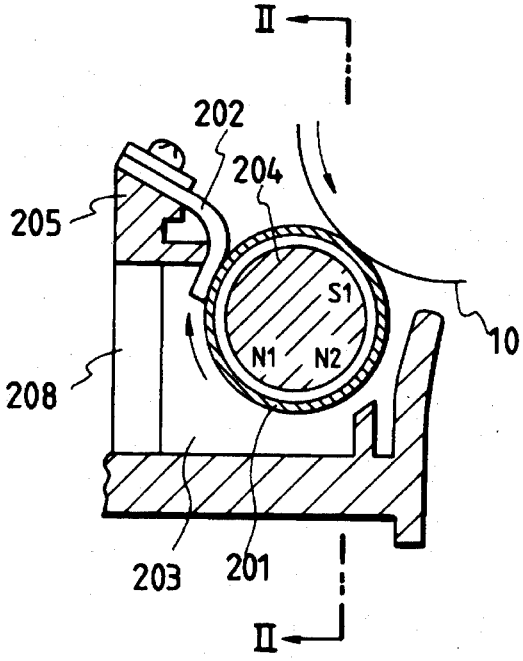
FIG. 6 is a sectional view of a developing sleeve and therearound, according to the present invention.
Figure 7:
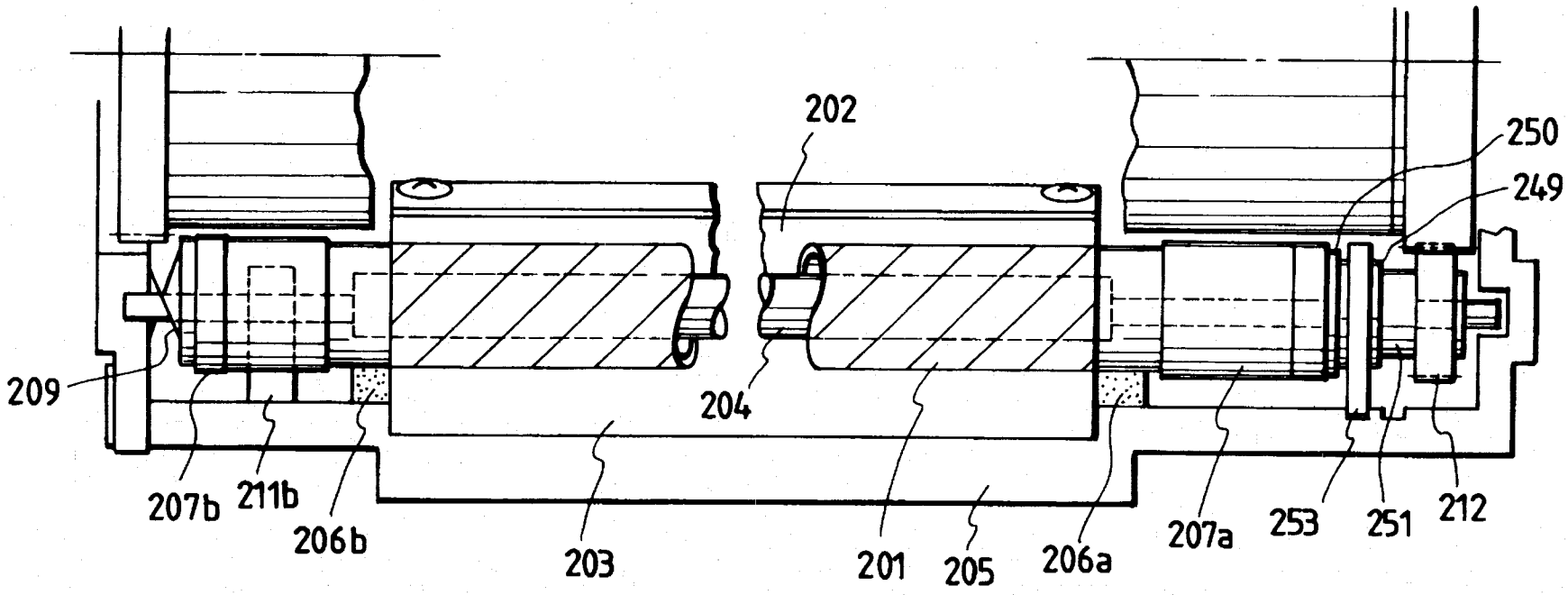
FIG. 7 is a longitudinal view of a developing sleeve and therearound, according to a second embodiment of the present invention, in a condition that a second bearing is arranged at a first position.

FIGS. 6 and 7 are cross-sectional view and a longitudinal view of a developing sleeve of a developing device for supplying toner on the photosensitive drum, respectively.

As shown in FIGS. 6 and 7, a pipe-shaped developing sleeve 201 is disposed in a developer chamber 203. A magnet roller 204 comprising magnets having a plurality of magnetic poles is contained within the developing sleeve 201. A developer blade 202 is urged against the developing sleeve 201. The developer blade 202 is attached to a developer container 205. The developing sleeve 201 is biased toward the photosensitive drum 10 acting as an image bearing member by means of a biasing means (not shown) while creating a predetermined clearance therebetween by spacer rollers 207*a*, 207*b* acting as clearance keeping members.

The toner or developer is supplied from a toner container by a conveying means (not shown) or free drop to the developer chamber 203 through an opening 208 of the developer chamber 203. The toner in the developer chamber 203 is attracted by one ($N_1$) of the magnetic poles of the magnet roller 204, thus being agitated by the rotating developing sleeve 201 to be gradually charged. A part of the toner is conveyed in a direction shown by the arrow in FIG. 6 by the rotation of the developing sleeve 201 and is sent between the developing sleeve and the developer blade 202, where the toner is strongly urged against the developing sleeve 201 by the developer blade 202, thus increasing the charge amount of the toner abruptly. The charged toner is then discharged out of the developer chamber 203 by the rotation of the developing sleeve 201. Incidentally, the developer blade 202 serves to not only charge the toner for increasing the charge amount of the toner, but also to regulate a thickness of a toner layer around the developing sleeve 201.

By the way, many of the developing sleeves are made from conductive material such as aluminium, and, as shown in FIG. 7, a bias plate 209 is incorporated into the interior of a pipe of the developing sleeve at its one end so that the developing bias is applied to the developing sleeve 201 from a development bias supply source (not shown) of the image forming system.

Accordingly, the toner conveyed from the developer chamber 203 by the developing sleeve 201 is transferred onto the electrostatic latent image on the photosensitive drum 10 by the development bias, thus developing the electrostatic latent image with the toner. Incidentally, the toner not used for the development is returned to the developer chamber 203 by the rotation of the developing sleeve 201.

Figure 8:
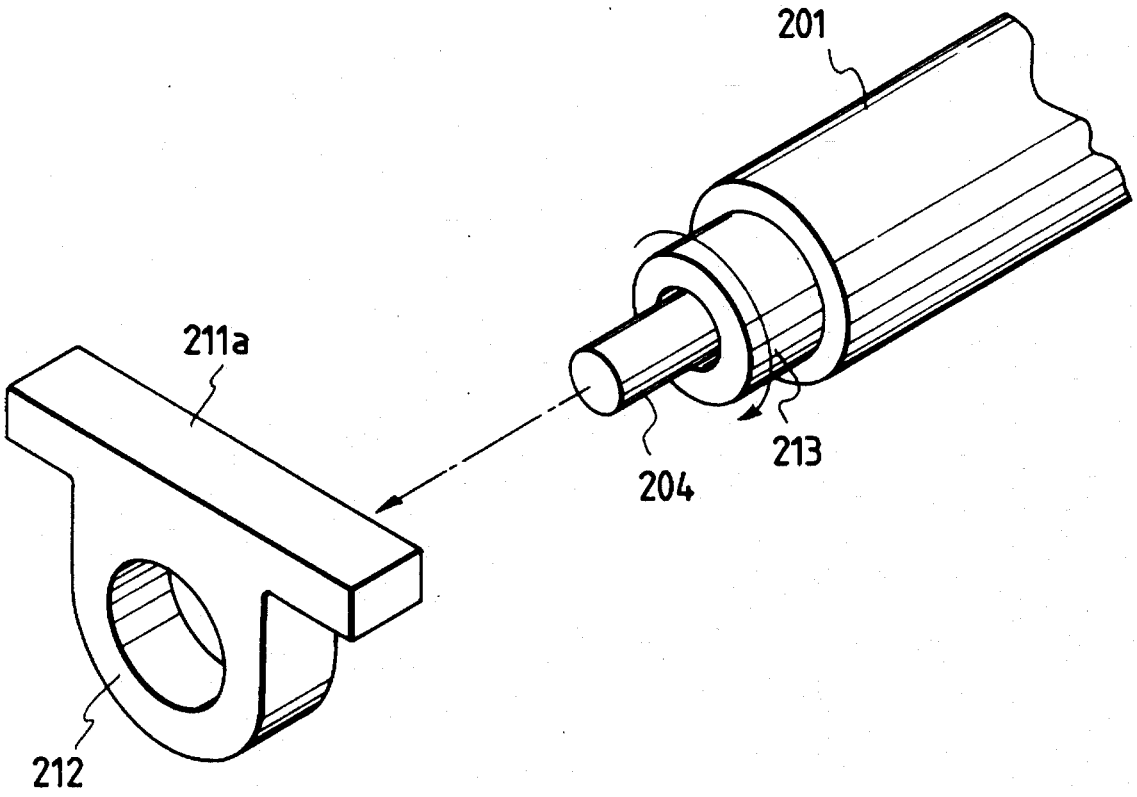
FIG. 8 is a perspective view of a developing flange and a bearing before they are fitted together.

At the other end of the developing sleeve 201, a flange 213 is fitted into the pipe of the developing sleeve 201 and is rotatably supported by a bearing 211*a* (see FIG. 8). On the other hand, as mentioned above, at other end of the developing sleeve 201, the spacer roller 207*b* is fitted on the pipe of the developing sleeve. The spacer roller is rotatably supported by a bearing 211*b*. Further, the magnet roller 204 has a shaft extension which is fixedly mounted on the developer container 205. As mentioned above, the flange 213 of the developing sleeve 201 is rotatably supported by the bearing 211*a*, and, thus, when the image forming system is operated and the developing sleeve is rotated, a peripheral surface of the flange 213 is frictionally slid with respect to an inner surface of the bearing 211*a*.

Thus, in a second embodiment of the present invention, a bearing slidingly contacted with a flange of a developing sleeve can be shifted from a first position before a process cartridge is reused to a second position after the process cartridge is reused. The second embodiment will be fully explained hereinafter.

Figure 9:
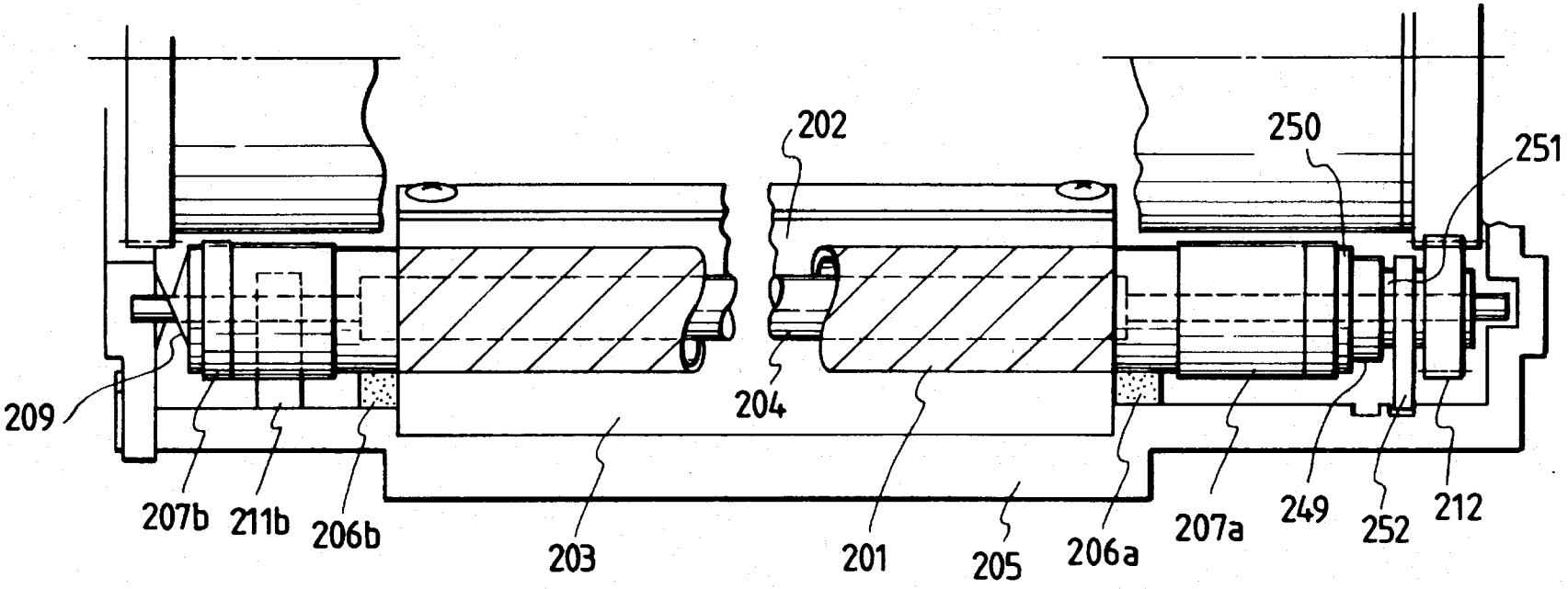
FIG. 9 is a longitudinal view of the developing sleeve and therearound, according to the second embodiment of the present invention, in a condition that the second bearing is arranged at a second position.

FIG. 7 is a longitudinal view of a developing device before a process cartridge of an image forming system is reused, and FIG. 9 is a longitudinal view of the developing device after the cartridge is reproduced or reused. It should be noted that, both before and after reuse, a flange 250 is fitted in the developing sleeve 201.

In FIG. 7, a first sliding portion (abutment portion) 249 of the flange 250 is supported by a first bearing 253. After reuse, as shown in FIG. 9, a second sliding portion 251 of the flange 250 is supported by a second bearing 252 which is constituted by members different from those of the first bearing 253. A diameter of the second sliding portion is smaller than that of the first sliding portion 249, and, accordingly, an inner diameter of the second bearing 252 is smaller than that of the first bearing 253. Further, the attachment accuracy between the first sliding portion 249 of the flange 250 and the bearing 253 is the same as that between the second sliding portion 251 and the bearing 252.

As mentioned above, merely by changing the bearing which is relatively cheap when the process cartridge reused or the image forming system is reproduced, it is possible to reuse the sleeve and the sleeve flange 250.

Incidentally, even when the sleeve flange 250 is situated on the sleeve 201 (i.e., when the there is no flange 250 and the sleeve itself is supported by the bearing), the same technical effect can be obtained. Further, even when there are three or more sliding portions of the sleeve flange 250, if the same number of bearings having the corresponding inner diameters are prepared, the developing device can be reused by plural times corresponding to the number of the bearings.

Next, a third embodiment of the present invention will be explained.

In the above-mentioned second embodiment, while only the developing sleeve and the sleeve flange could be reused, in this third embodiment, the bearing can also be reused. This embodiment will be explained with reference to FIGS. 10 and 11.

Figure 11:
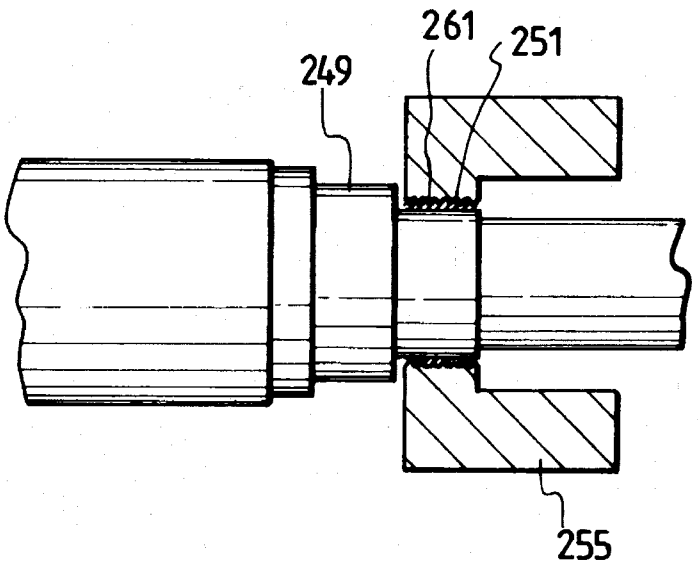
FIG. 11 is a partial sectional view showing a condition that the bearing is fitted on a second position of the developing flange, according to the third embodiment of the present invention.
Figure 10:
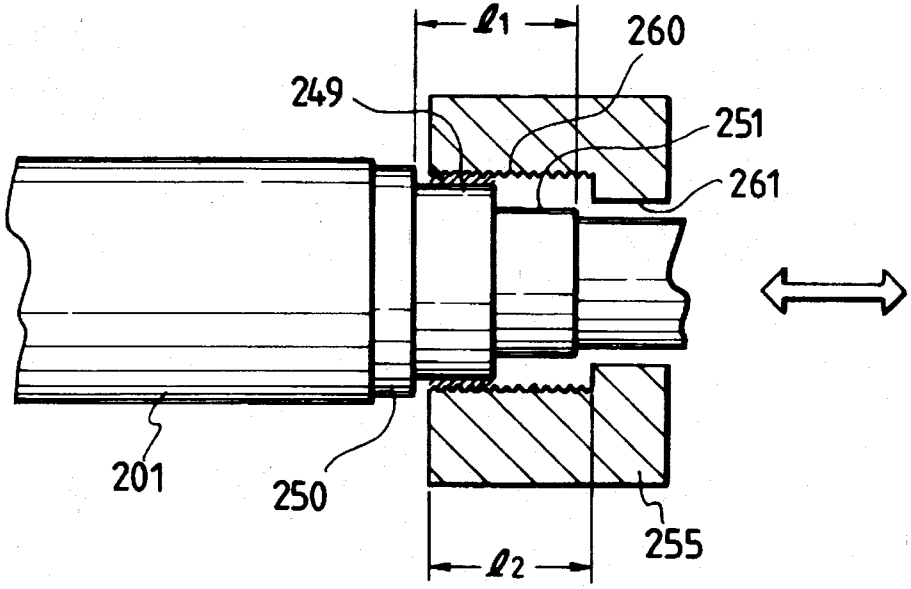
FIG. 10 is a partial sectional view showing a condition that a bearing is fitted on a first position of a developing flange, according to a third embodiment of the present invention.

The constructions of a sleeve 201 and a sleeve flange 250 are the same as those in the second embodiment. A bearing 255 has a construction as shown in FIGS. 10 and 11. In FIG. 10, the bearing 255 has two sliding surfaces (260, 261), and the sleeve flange 250 and the sleeve 201 are held by a sliding portion 261 of the bearing 255 having an inner diameter corresponding to a diameter of a first sliding surface 249 of the sleeve flange 250.

Now, the sum $l_1$ of lengths of the first and second sliding surfaces 249, 251 of the sleeve flange 250 along a longitudinal direction of the developing sleeve is selected to be smaller than a longitudinal length $l_2$ of the sliding portion 260 of the bearing 255 (i.e., $l_1<l_2$). The reason is that, in FIG. 10, if $l_1 \geqq l_2$ the second sliding portion 251 of the sleeve flange 250 will interfere with the second sliding portion 261 of the bearing 255.

Now, when the process cartridge is reused or the image forming system is reproduced, if the dimensional accuracy of the first sliding surface 249 of the sleeve flange 250 and the sliding portion 260 of the bearing 255 is worsened due to the wear generated by the sliding contact therebetween, as shown in FIG. 11, the bearing 255 is once dismounted, and then is mounted again so that the second sliding portion 261 of the bearing 255 is fitted onto the second sliding surface 251 of the sleeve flange 250.

In this way, since not only the sleeve 201 and the sleeve flange 250 but also the bearing 255 can be reused, the third embodiment is more economical than the second embodiment.

Incidentally, of course, it should be understood that, when any non-sliding surface (not shown) such as taper, R and the like is formed between the first and second sliding surfaces of the flange, the above-mentioned relation regarding $l_1<l_2$ should be changed to $(l_1+x)<L_2$ (where, x is a longitudinal length of the non-sliding surface).

Next, a fourth embodiment of the present invention will be explained with reference to FIGS. 12 to 14. Also in this embodiment, the constructions of the sleeve 201 and the sleeve flange 250 are the same as those in the second and third embodiments.

Figures 12, 13, 14:
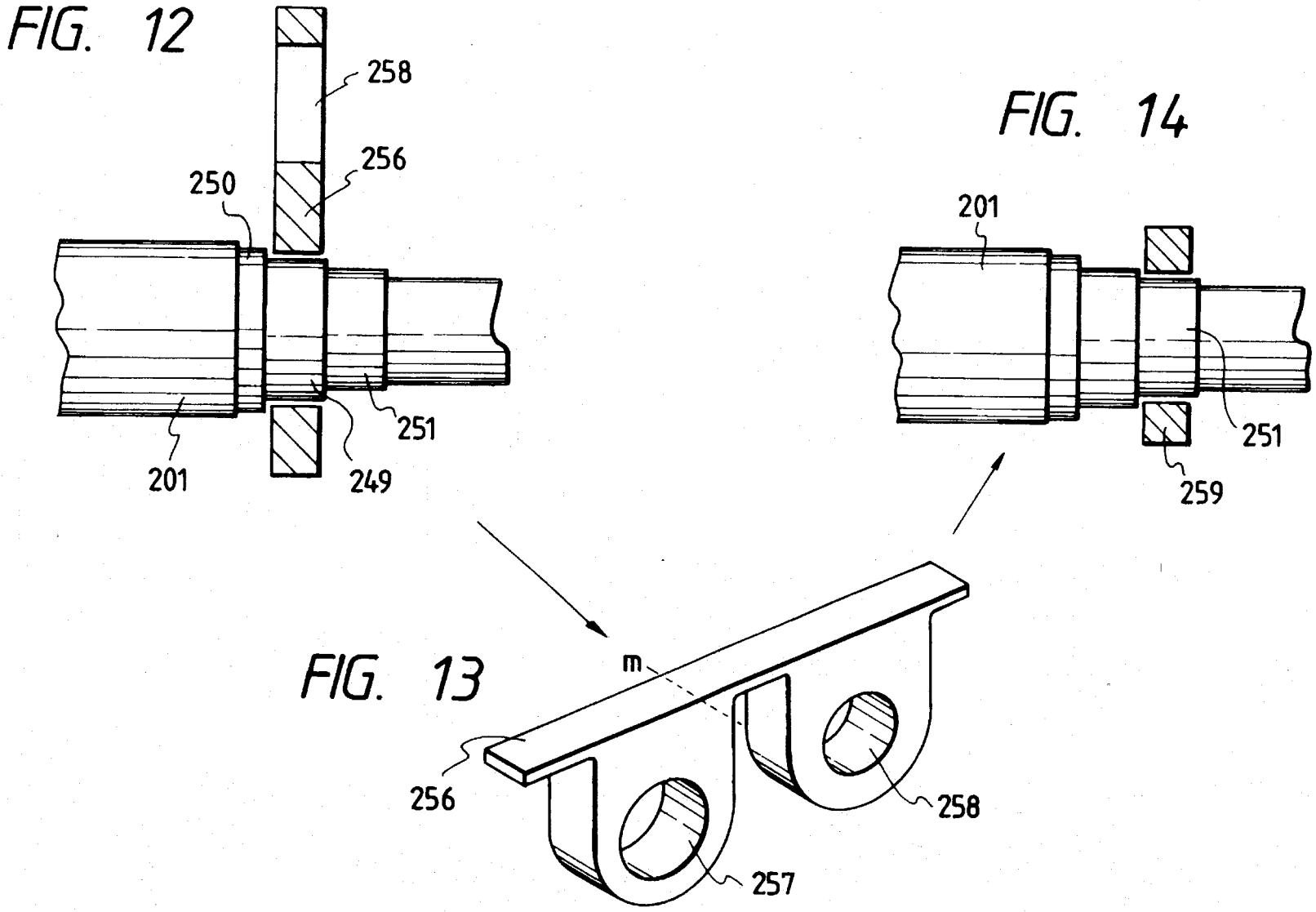
FIG. 12 is a partial sectional view showing a condition that a first bearing portion of a bearing is fitted on a first position of a developing flange, according to a fourth embodiment of the present invention.
FIG. 13 is a perspective view of the bearing of FIG. 12.
FIG. 14 is a partial sectional view showing a condition that a second bearing portion of the bearing is fitted on a second position of the developing flange, according to the fourth embodiment of the present invention.

In FIG. 12, a bra ring 256 has fitting portions or holes 257, 258 corresponding to the first and second sliding surfaces 249, 251 of the sleeve flange 250. FIG. 12 shown a condition that the first sliding surface 249 of the sleeve flange 250 is fitted into and supported by the first fitting hole 257 of the bearing 256. In this case, the second fitting hole 258 of the bearing 256 is disposed along a direction that is perpendicular to an axis of the sleeve and that is not interfered with the photosensitive drum.

When the dimensional accuracy of the fitting portion of the bearing is worsened in use due to the frictional wear or when the second-hand developing sleeve is reused, the bearing 256 is once dismounted from the sleeve flange 250 and is divided into two pieces along a tearing line m shown in FIG. 13. Thereafter, by fitting the bearing portion 259 having the second fitting hole 258 onto the second sliding surface 251 of the sleeve flange 250 as shown in FIG. 14, the sleeve flange can be supported by the bearing portion properly.

In this way, the bearing can also be reused. This fourth embodiment is effective in the case where there is no sufficient space along the longitudinal direction of the sleeve unlike the third embodiment.

Further, so long as the bearing 256 has discrete fitting holes corresponding to the sliding surfaces 249, 251 of the sleeve flange 250 and can be utilized even when it is divided into two pieces as in the above example, the same technical effect can be obtained.

What is claimed is:

1. A method of reusing a rotation member used in an image forming apparatus, wherein the rotation member is supported at one of a plurality of coaxial rotation surfaces, each of which has a different diameter and is shifted axially from one another, by a corresponding support surface of one of a plurality of bearing members, comprising the steps of:

detaching the one of the plurality of bearing members that supports the rotation member at the one of the plurality of coaxial rotation surfaces; and attaching another of the plurality of bearing members at a corresponding other of the plurality of coaxial rotation surfaces that has a different diameter than the one of the plurality of coaxial rotation surfaces.

2. A method according to claim 1, wherein the rotation member comprises a developing sleeve for conveying toner used for developing a latent image formed on a photosensitive member and said detaching step comprises detaching the one of the plurality of bearing members from the developing sleeve.

3. A method according to claim 2, wherein the other of the plurality of coaxial rotation surfaces to which the other bearing member is attached has a smaller diameter than the one of the coaxial rotation surfaces from which the one bearing member is detached.

4. A method according to claim 2, wherein said attaching step comprises attaching a bearing member having a diameter smaller than the diameter of the one bearing member detached in said detaching step.

5. A method according to claim 1, wherein the rotation member comprises a pipe having a flange fitted to an inner surface thereof and the one of the plurality of bearing members supports the flange, and said detaching step comprises detaching the one of the plurality of bearing members from the flange.

6. A method according to claim 1, wherein the other of the plurality of coaxial rotation surfaces to which the other bearing member is attached has a smaller diameter than the one of the coaxial rotation surfaces from which the one bearing member is detached.

7. A method according to claim 1, wherein said attaching step comprises attaching a bearing member having a diameter smaller than the diameter of the one bearing member detached in said detaching step.

8. A method of reusing a developing sleeve for use in an image forming apparatus for supplying a toner to a photosensitive member to develop a latent image formed thereon, wherein the developing sleeve is supported at one of a plurality of coaxial rotation surfaces, each of which has a different diameter and is shifted axially from one another, by a corresponding support surface of one of a plurality of bearing members, said method comprising the steps of:

detaching the one of the plurality of bearing members that supports the developing sleeve at the one of the plurality of coaxial rotation surfaces; and attaching another of the plurality of bearing members at a corresponding other of the plurality of coaxial rotation surfaces that has a different diameter than the one of the plurality of coaxial rotation surfaces.

9. A method according to claim 8, wherein the other of the plurality of coaxial rotation surfaces to which the other bearing member is attached has a smaller diameter than the one of the coaxial rotation surfaces from which the one bearing member is detached.

10. A method according to claim 8, wherein said attaching step comprises attaching a bearing member having a diameter smaller than the diameter of the one bearing member detached in said detaching step.

11. A method according to claim 8, wherein the developing sleeve comprises a pipe having a flange fitted to an inner surface thereof and the one of the plurality of bearing members supports the flange, and said detaching step comprises detaching the one of the plurality of bearing members from the flange.

12. A method according to claim 11, wherein the other of the plurality of coaxial rotation surfaces to which the other bearing member is attached has a smaller diameter than the one of the coaxial rotation surfaces from which the one bearing member is detached.

13. A method according to claim 11, wherein said attaching step comprises attaching a bearing member having a diameter smaller than the diameter of the one bearing member detached in said detaching step.

* * * * *

UNITED STATES PATENT AND TRADEMARK OFFICE

CERTIFICATE OF CORRECTION

PATENT NO. : 5,528,341

DATED : June 18, 1996

INVENTOR(S) : KAZUO SHISHIDO, ET AL.

It is certified that error appears in the above-indentified patent and that said Letters Patent is hereby corrected as shown below:

ON THE COVER PAGE

[54] Title

"PROCESS CARTRIDGE WITH ROTARY MEMBER HAVING BEARING ATTACHMENT PORTIONS OF DIFFERENT DIAMETERS, AND METHOD FOR REFUSING SUCH A ROTARY MEMBER" should read --PROCESS CARTRIDGE WITH ROTARY MEMBER HAVING BEARING ATTACHMENT PORTIONS OF DIFFERENT DIAMETERS, AND METHOD FOR REUSING SUCH A ROTARY MEMBER--.

COLUMN 1

Line 4, "REFUSING" should read --REUSING--; and
Line 26, --from-- should be inserted after "cartridge"; and
Line 28, "member, has worn out" should read --member has worn out,--.

COLUMN 3

Line 18, "to make" should read --make--.

UNITED STATES PATENT AND TRADEMARK OFFICE

CERTIFICATE OF CORRECTION

PATENT NO. : 5,528,341

DATED : June 18, 1996

INVENTOR(S) : KAZUO SHISHIDO, ET AL.

It is certified that error appears in the above-indentified patent and that said Letters Patent is hereby corrected as shown below:

COLUMN 4

Line 2, "132, i.e.," should read --132 lie--;
Line 9, "an urethane" should read --a urethane--;
Line 22, "132f." should read --132e and 132f.--;
Line 23, "its both" should read --both its--;
Line 24, "portion" should read --portions--; and
Line 47, "aginst" should read --against--.

COLUMN 6

Line 13, "are" should read --are a--; and
Line 67, "at other" should read --at the other--.

COLUMN 7

Line 40, "the there" should read --there--.

UNITED STATES PATENT AND TRADEMARK OFFICE

CERTIFICATE OF CORRECTION

PATENT NO. : 5,528,341

DATED : June 18, 1996

INVENTOR(S) : KAZUO SHISHIDO, ET AL.

It is certified that error appears in the above-indentified patent and that said Letters Patent is hereby corrected as shown below:

COLUMN 8

Line 1, "if $l_1 \geq l_2$" should read --if $l_1 \geq l_2$,--;
Line 30, "shown" should read --shows--; and
Line 35, "is not interfered" should read --does not interfere--.

Signed and Sealed this

Eleventh Day of February, 1997

Bruce Lehman

BRUCE LEHMAN

*Commissioner of Patents and Trademarks*

*Attest:*

*Attesting Officer*